US005435567A

United States Patent [19]

Compres

[11] Patent Number: 5,435,567

[45] Date of Patent: Jul. 25, 1995

[54] BASEBALL BOARD GAME

[76] Inventor: Hector J. Compres, 3858 Euclid Ave., Sand Diego, Calif. 92105

[21] Appl. No.: 259,064

[22] Filed: Jun. 13, 1994

[51] Int. Cl.[6] ..... A63F 3/00

[52] U.S. Cl. ..... 273/244; 273/256; 273/93 C

[58] Field of Search ..... 273/244, 93 C, 256

[56] References Cited

U.S. PATENT DOCUMENTS

| | | | |
|---|---|---|---|
| 1,401,844 | 12/1921 | Westphal | 273/93 C |
| 1,519,133 | 12/1924 | Hall | 273/249 |
| 4,000,897 | 1/1977 | York | 273/93 C |
| 4,486,022 | 12/1984 | Dixon | 273/244 |

*Primary Examiner*—Benjamin H. Layno

[57] ABSTRACT

A baseball board game played with playing cards, memo cards, player cards, play money, and miniature players for movement around a board along two paths of travel. Miniaturized baseball player figures constituting sets of distinctive markers move around the first path of travel and the second path of travel. The board is rectangular and is formed with nine small blocks located along each edge of the board and with a large box with instructional information at each corner which together constitute a first path of travel. The board also has indicia in the center of the board with a home plate and three bases which together constitute. A second path of travel; a plurality of playing cards give numerical information to a participant for the movement of miniaturized players around the first path of travel. A plurality of memo cards are also provided adapted to give play-type information to a participant for movement of miniaturized players around the second path of travel. A plurality of player cards are also provided each showing individual player information on the front side and career history on the back side, the player cards being divided into suits, the suit being designated on the front side by a team logo. A quantity of play money is used by participants for the purchasing of player cards in an effort to be the first participant to complete a team of players.

1 Claim, 3 Drawing Sheets

BASEBALL BOARD GAME

BACKGROUND OF THE INVENTION

1. Field of the Invention

The present invention relates to a game played with playing cards, memo cards, player cards, play money, and miniature players for movement around a board along two paths of travel and more particularly pertains to providing entertainment and testing baseball knowledge in a game of skill and chance.

2. Description of the Prior Art

The use of board games of various configurations and rules is known in the prior art. More specifically, board games of various configurations and rules heretofore devised and utilized for the purpose of entertaining and testing the skill and luck of players of board games of various types are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,972,530 a board baseball game.

U.S. Pat. No. 4,452,453 discloses a baseball board game apparatus.

U.S. Pat. Nos. 5,125,658 and 5,183,266 disclose a baseball board game.

U.S. Pat. No. 5,129,651 discloses a baseball board game and method of play.

U.S. Pat. No. 5,201,520 discloses a baseball game apparatus.

In this respect, a game played with playing cards, memo cards, player cards, play money, and miniature players for movement around a board along two paths of travel according to the present invention substantially departs from the conventional concepts and designs of the prior art, and in doing so provides an apparatus primarily developed for the purpose of providing and testing baseball knowledge in a game of chance and skill.

Therefore, it can be appreciated that there exists a continuing need for a new and improved game played with playing cards, memo cards, player cards, play money, and miniature players for movement around a board along two paths of travel which can be used to provide entertainment and test baseball knowledge in a game of chance and skill. In this regard, the present invention substantially fulfills this need.

SUMMARY OF THE INVENTION

In view of the foregoing disadvantages inherent in the known types of board games of various configurations now present in the prior art, the present invention provides a new and improved game played with playing cards, memo cards, player cards, play money, and miniature players for movement around a board along two paths of travel. As such, the general purpose of the present invention, which will be described subsequently in greater detail, is for providing entertainment and testing baseball knowledge and method which has all the advantages of the prior art and none of the disadvantages.

To attain this, the present invention essentially comprises a new and improved game played with playing cards, memo cards, player cards, play money, and miniature players for movement around a board along two paths of travel, comprising, in combination, a board in a rectangular configuration formed with nine small blocks representative of nine baseball players located along each edge of the board and with a large box with instructional information at each corner which together constitute a first path of travel, the board also having indicia in the center of the board with a home plate and three bases which together constitute a second path of travel; a plurality of eight miniaturized baseball player figures constituting four sets of distinctive markers for movement by the participants around the first path of travel and the second path of travel; a plurality of forty playing cards adapted to give numerical information to a participant for the movement of miniaturized players around the first path of travel; a plurality of one hundred eleven memo cards adapted to give play-type information to a participant for movement of miniaturized players around the second path of travel; a plurality of thirty-six player cards each showing individual player information on the front side and career history on the back side for being acquired by the participants, the player cards being divided into four suits, the suit being designated on the front side by a team logo; and a quantity of play money in a plurality of denominations to be used by participants for the purchasing of player cards in an effort to be the first participant to complete a team of players.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved game played with playing cards, memo cards, player cards, play money, and miniature players for movement around a board along two paths of travel which has all the advantages of the prior art board games of various configurations and rules and none of the disadvantages.

It is another object of the present invention to provide a new and improved game played with playing cards, memo cards, player cards, play money, and miniature players for movement around a board along two paths of travel which may be easily and efficiently manufactured and marketed.

It is a further object of the present invention to provide a new and improved game played with playing cards, memo cards, player cards, play money, and miniature players for movement around a board along two paths of travel which is of durable and reliable construction.

An even further object of the present invention is to provide a new and improved game played with playing cards, memo cards, player cards, play money, and miniature players for movement around a board along two paths of travel which is susceptible of a low cost of manufacture with regard to both materials and labor, and which accordingly is then susceptible of low prices of sale to the consuming public, thereby making such game played with playing cards, memo cards, player cards, play money, and miniature players for movement around a board along two paths of travel economically available to the buying public.

Still yet another object of the present invention is to provide a new and improved game played with playing cards, memo cards, player cards, play money, and miniature players for movement around a board along two paths of travel therearound which provides in the apparatuses and methods of the prior art some of the advantages thereof, while simultaneously overcoming some of the disadvantages normally associated therewith.

Still another object of the present invention is to provide entertainment and a test of baseball knowledge in a game of chance and skill.

Lastly, it is an object of the present invention to provide a new and improved game played with playing cards, memo cards, player cards, play money, and miniature players for movement around a board along two paths of travel, comprising a plurality of miniaturized baseball player figures constituting sets of distinctive markers for movement by the participants around the first path of travel and the second path of travel; a board in a rectangular configuration formed with nine small blocks located along each edge of the board and with a large box with instructional information at each corner which together constitute a first path of travel, the board also having indicia in the center of the board with a home plate and three bases which together constitute a second path of travel; a plurality of playing cards adapted to give numerical information to a participant for the movement of miniaturized players around the first path of travel; a plurality of memo cards adapted to give play-type information to a participant for movement of miniaturized players around the second path of travel; a plurality of player cards each showing individual player information on the front side and career history on the back side, the player cards being divided into suits, the suit being designated on the front side by a team logo; and a quantity of play money to be used by participants for the purchasing of player cards in an effort to be the first participant to complete a team of players.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
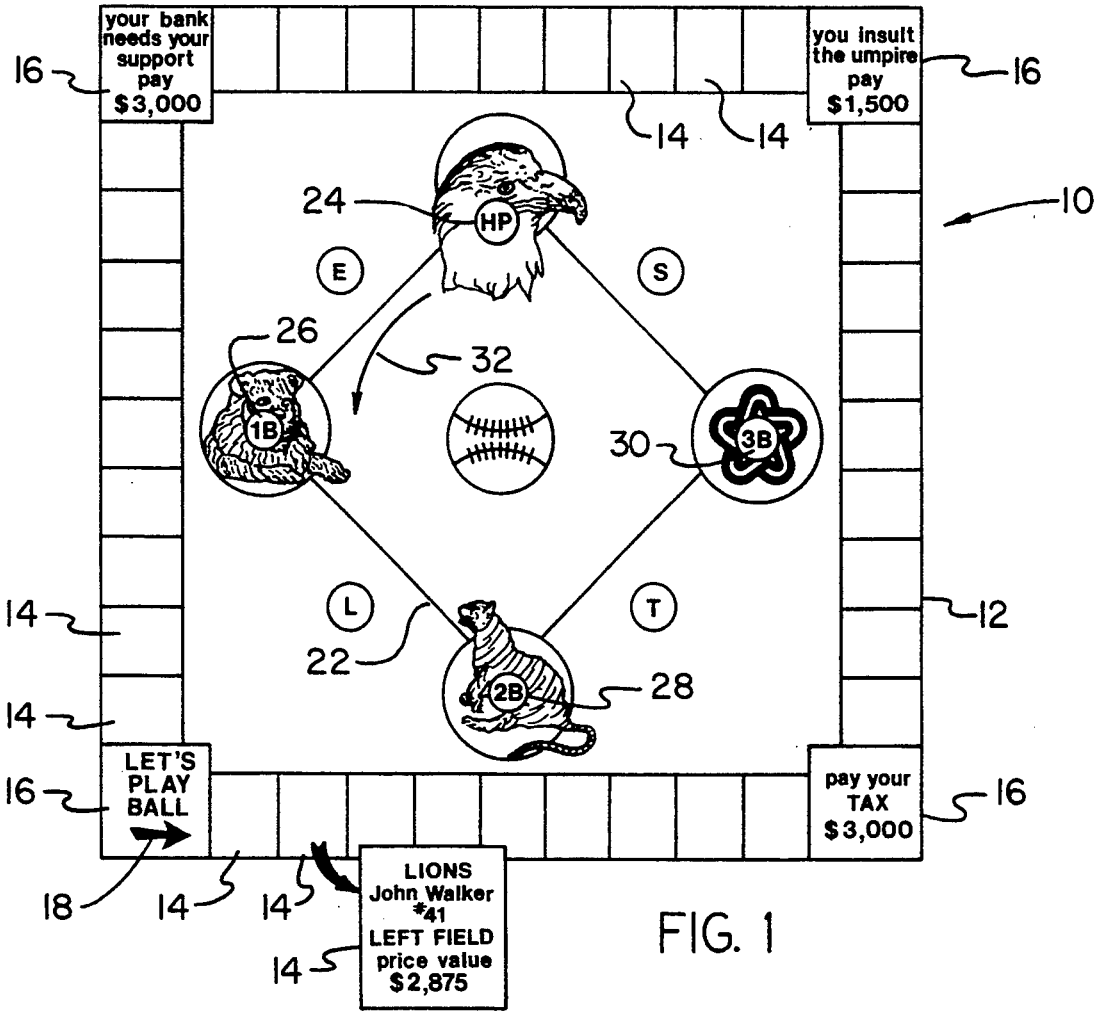
FIG. 1 is a plan view of the preferred embodiment of the game played with playing cards, memo cards, player cards, play money, and miniature players and a board in a rectangular configuration with spaces for movement therearound, constructed in accordance with the principles of the present invention.
Figure 2:
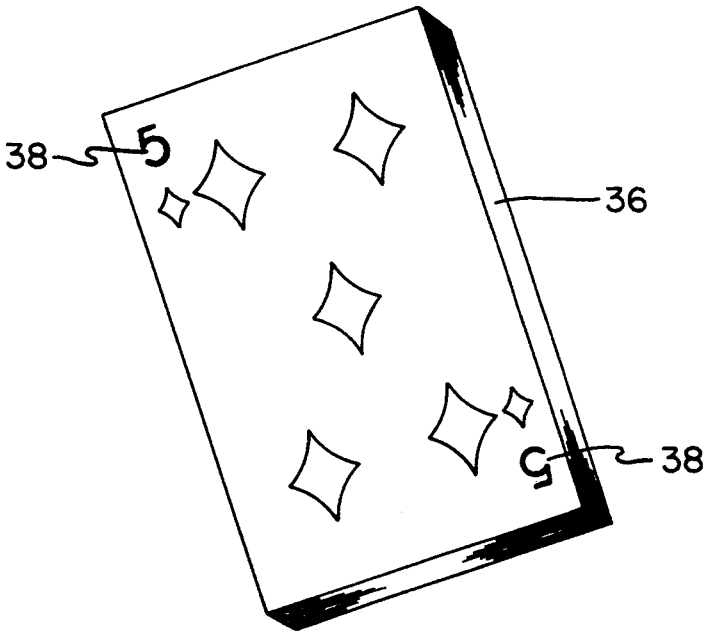
FIG. 2 is a deck of playing cards for use in association with the board game of FIG. 1.
Figure 3:
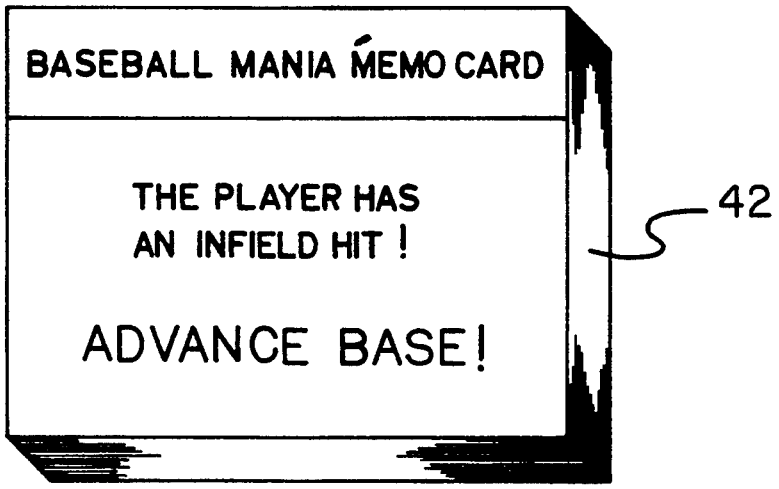
FIG. 3 is a stack of memo cards for use in association with the board shown in FIG. 1.
Figure 4:
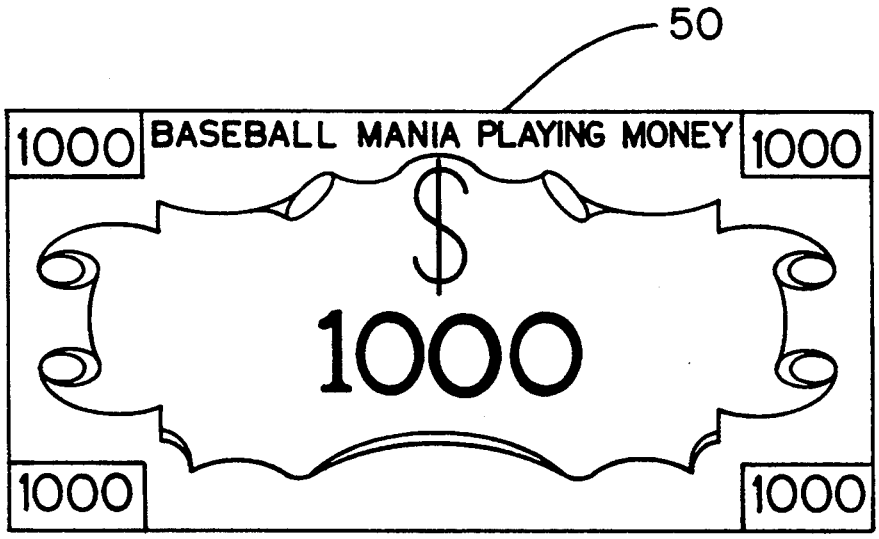
FIG. 4 is one type of play money used in association with the board shown in FIG. 1.
Figure 5:
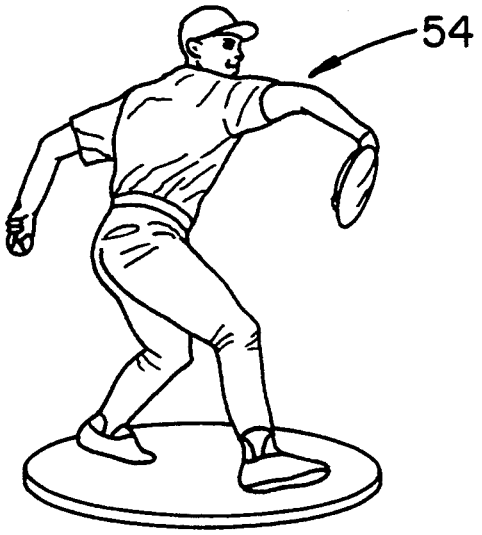
FIG. 5 is one miniature baseball player for use in association with the board shown in FIG. 1.
Figure 6:
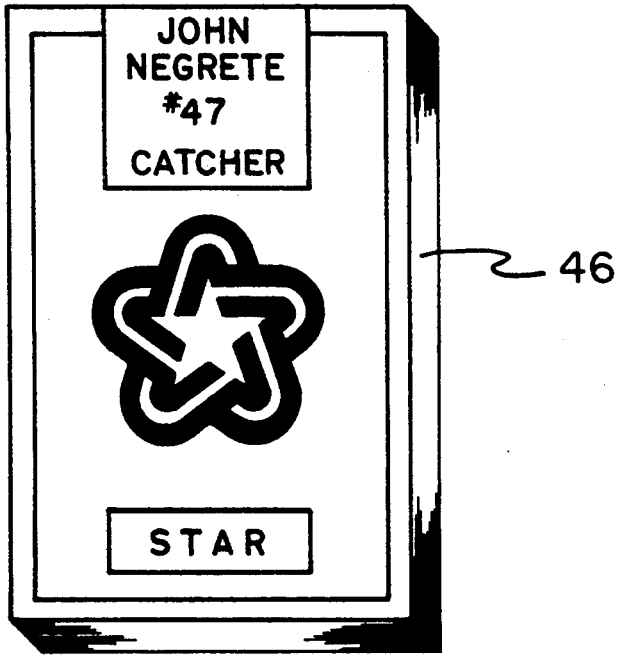
FIG. 6 is a stack of player cards for use in association with the board game of FIG. 1.

With reference now to the drawings, and in particular to FIG. 1 thereof, the preferred embodiment of the new and improved game played with playing cards, memo cards, player cards, play money, and miniature players for movement around a board along two paths of travel embodying the principles and concepts of the present invention and generally designated by the reference numeral 10 will be described.

The present invention, the new and improved game played with playing cards, memo cards, player cards, play money, and miniature players for movement around a board along two paths of travel, is comprised of a plurality of components. Such components are individually configured and correlated with respect to each other so as to attain the desired objective. The components comprise a board, playing cards, memo cards, player cards, play money and baseball player figures for movement around the board.

The central component of the system 10 is a board 12. The board is in a rectangular configuration. It is formed with nine small blocks 14 representative of nine baseball players of a team located along each edge of the board. In addition, a large block 16 with instructional information is placed at each corner. The large and small blocks together constitute a first path of travel 18. In addition, indicia 22 is provided in the center of the board with a home plate 24 and three bases 26, 28, 30 constituting a second path of travel 32.

Next provided are a plurality of playing cards 36 in a deck. The playing cards, forty in number with ten cards for each of four suits, are adapted to give instructional information to a participant for the movement of miniaturized players around the first path of travel. Each card has a number 38 from one to ten. When drawn by a participant from the top of the deck, a player will move his player around the first path of travel by the number of spaces corresponding to the drawn number.

A plurality of memo cards 42 are next provided. Such memo cares are adapted to give instructional information to a participant for movement of a miniaturized player around the second path of travel. The memo cards are drawn from a stack of such memo cards. The stack has, preferably, one hundred eleven cards with different information for different play-type actions to be taken after being drawn.

Next provided are a plurality of player cards 46. Thirty-six such player cards are provided. This is four teams with team logos and nine players for each team, one for each position. The player cards show the individual player information on the front. They also include a career history on the back. These player cards are for being acquired by the participants. The player cards are divided into four suits. The suits are designated on the back side of the card and are representative of a team logo for each of the four teams.

The next component of the system is play money 50. The play money is in a plurality of dollar denominations. The play money is used by the participants for purchasing player cards. The object is to acquire player cards to complete a team of players. A player may be bought with play money by a participant upon landing on that player's small block after passing around the board one time. Participants may also trade player cards.

The last components of the system are the eight miniaturized baseball player FIGS. 54. Such figures constitute four sets of distinctive markers. Each set has two players. One player is to move around the periphery of the board as directed by the playing cards selected in an effort to land on specific player spaces. When on such spaces the participant may purchase such player card with the play money. The second miniaturized player is adapted to move around the second path of travel in response to the instructional information on the memo card selected by the participant. Such movement is for scoring a maximum of runs. Termination of a participant's turn occurs upon reaching three outs for any inning.

The present invention is a complete game board designed to look like a baseball stadium and field, all built in miniature to a 22 inch×22 inch square. It is all about baseball entertainment where four participants, ages seven years and up, must try to buy baseball players to complete each one team of nine players at the same time they are participating in a baseball game of nine innings. The entire game is full of home runs, steals, foul balls, base advances, encounters with the umpire, suspensions and participants actually collect playing money. The game board includes forty playing cards, baseball mania memo cards, baseball miniature figurines, a bank of baseball mania playing money, baseball players who are divided in four teams, one stadium, a complete manual of instructions and rules. Such manual and its entire contents are incorporated herein by reference and form a part of this application.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved game played with playing cards, memo cards, player cards, play money, and miniature players for movement around a board along two paths of travel, comprising, in combination:

a board in a rectangular configuration formed with nine small blocks representative of nine baseball players located along each edge of the board and with a large box with instructional information at each corner which together constitute a first path of travel, the board also having indicia in the center of the board representing a baseball field with a home plate and three bases which together constitute a second path of travel, the home plate and bases being located adjacent to the central extent of each edge of the board remote from the corners;

a plurality of eight miniaturized baseball player figures constituting four sets of distinctive markers for movement by the participants around the first path of travel and the second path of travel;

a plurality of forty playing cards each playing card consisting of numerical indicia for the movement of miniaturized players around the first path of travel;

a plurality of one hundred eleven memo cards, each memo card consisting of baseball play-type information representing a result of a baseball player's at bat and indicia instructing the movement of miniaturized players around the second path of travel from base to base resulting from said play-type information;

a plurality of thirty-six player cards each showing individual player information on the front side and career history on the back side for being separately acquired by the participants, the player cards being divided into four different suits, the suit being designated on the front side by a team logo; and a quantity of play money in a plurality of denominations to be used by participants for the purchasing of player cards in an effort to be the first participant to complete a team of players.

* * * * *